US006354068B1

(12) United States Patent
Onuma et al.

(10) Patent No.: US 6,354,068 B1
(45) Date of Patent: Mar. 12, 2002

(54) STEEL CORDS FOR REINFORCEMENT OF RUBBER ARTICLES PNEUMATIC TIRE PROCESS FOR PRODUCING STEEL CORD AND TUBULAR-TYPE TWISTING MACHINE THEREFOR

(75) Inventors: Shuichi Onuma, Kodaira; Naohiko Obana, Kuroiso; Chihiro Yoshida, Nasu-Gun, all of (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/598,760

(22) Filed: Jun. 22, 2000

(30) Foreign Application Priority Data

Jun. 23, 1999 (JP) ..... 11-176408
Jun. 24, 1999 (JP) ..... 11-177716

(51) Int. Cl.[7] ..... D07B 1/06

(52) U.S. Cl. ..... 57/212; 57/211; 57/213; 57/214; 57/215; 57/218; 57/219; 57/236; 57/237; 57/238

(58) Field of Search ..... 57/211, 212, 213, 57/214, 215, 218, 219, 236, 237, 238; 152/451

(56) References Cited

U.S. PATENT DOCUMENTS 5,718,783 A * 2/1998 Ikehara ..... 152/527

FOREIGN PATENT DOCUMENTS

| | | | |
|---|---|---|---|
| JP | 63-176702 | | 7/1988 |
| JP | 63176702 | * | 7/1988 |
| JP | 9-158065 | | 6/1997 |
| JP | 09158065 | * | 6/1997 |

* cited by examiner

*Primary Examiner*—John J. Calvert
*Assistant Examiner*—Shaun R Hurley
(74) *Attorney, Agent, or Firm*—Sughrue Mion, PLLC

(57) ABSTRACT

A steel cord comprises a core of three or more filaments bundled without twisting and a sheath of at least one layer comprised of plural filaments wound around the core, wherein all core filaments are arranged in a given rectangle at any section in its longitudinal direction. Such steel cords are used in a belt of a pneumatic tire. And also, these cords are produced by a tubular-type twisting machine having a specified structure.

9 Claims, 13 Drawing Sheets

$\theta = 180°$ $\theta = 150°$ $\theta = 90°$ $\theta = 60°$

STEEL CORDS FOR REINFORCEMENT OF RUBBER ARTICLES PNEUMATIC TIRE PROCESS FOR PRODUCING STEEL CORD AND TUBULAR-TYPE TWISTING MACHINE THEREFOR

BACKGROUND OF THE INVENTION

1. Field of the Invention

This invention relates to a steel cord, particularly a flattened steel cord used as a reinforcement in rubber articles such as pneumatic tires and industrial belts and the like and a pneumatic tire using such a cord.

Further, the invention relates to a process for producing the above steel cord and a tubular-type twisting machine used therefor.

2. Description of Related Art

Various structures are known in the steel cord reinforcing a pneumatic tire as a typical example of a rubber article. In recent years, it is proposed to flatten the steel cord in order to improve various properties of the steel cord for use in the tire. That is, there is proposed a steel cord comprising a core formed by bundling three or more filaments without twisting each other and at least one sheath formed by winding a plurality of filaments around the core. This type of the cord has advantages that the anisotropy of the bending rigidity is large and the tensile rigidity is high as compared with a steel cord having a core formed by twisting a plurality of filaments or a core comprised of two untwisted filaments. And also, it is not required to twist the filaments as the core as compared with a steel cord having a core formed by twisting a plurality of filaments, so that it is advantageously possible to produce the steel cord at a few number of steps.

For example, JP-A-63-176702 discloses a steel cord comprising a core comprised of three filaments arranged in parallel to each other and a sheath comprised of plural filaments surrounding therearound.

In such a cord, however, the core filaments arranged in parallel extend straightforward in the longitudinal direction thereof, so that when tensile load is applied to the cord, the core filaments preferentially bear such a load and hence the bearing efficiency of tensile load as a whole of the cord lowers and the durability of the cord is poor. And also, the tensile rigidity is high on one hand and the elongation is low on the other hand, so that the cord has a disadvantage that the absorption energy through the elongation deformation is small.

On the other hand, JP-A-9-158065 discloses a steel cord having a core comprised of three filaments arranged without twisting and such a cross sectional shape of the cord that an elliptical shape and an approximately true circular shape are mixed in the longitudinal direction of the cord. In this cord, remarkably different cross sections are existent in the longitudinal direction of the cord, so that the bending deformation is not uniform in the longitudinal direction of the cord and the durability to bending is degraded.

SUMMARY OF THE INVENTION

It is, therefore, an object of the invention to provide a steel cord, particularly a flattened steel cord comprising a core formed by arranging plural untwisted filaments side by side and having an excellent tensile rigidity without damaging the bending anisotropy as well as a pneumatic tire having an excellent durability.

It is another object of the invention to provide a process for producing the above steel cord and a tubular-type twisting machine used therefor.

According to a first aspect of the invention, there is the provision of in a steel cord comprising a core formed by bundling three or more filaments side by side without twisting and a sheath of at least one layer comprised of plural filaments wound around the core, an improvement wherein an arrangement of the filaments constituting the core at a section perpendicular to a longitudinal direction of the core differs between at least a part in the longitudinal direction of the core and the other part thereof, and all filaments constituting the core in all section parts are arranged in a rectangle having a long side of $d\times(n+1)$ and a short side of $d\times(1+1/2^{1/2})$ when a diameter of the filament is d and the number of the filaments in the core is n.

In a preferable embodiment of the first aspect, all filaments constituting the core are arranged in a rectangle having a long side of $d\times(n+0.5)$ and a short side of $d\times(1+1/2)$.

In another preferable embodiment of the first aspect, the arrangement of the filaments constituting the core has different parts within one winding pitch of the sheath.

In the other preferable embodiment of the first aspect, a difference between one winding pitch of the sheath and a straight-extended length of each filament constituting the core existent in one winding pitch is is 0.9–1.1 times a stretchable amount of the sheath in an axial direction of the cord within one winding pitch of the sheath.

In a further preferable embodiment of the first aspect, the number of filaments in the core is three or four.

In a still further preferable embodiment of the first aspect, the filaments in the core are closed to each other.

In a further preferable embodiment of the first aspect, the sheath is one layer.

In a still further preferable embodiment of the first aspect, a direction of maximum diameter in the core is substantially the same at any cross section in the longitudinal direction of the core.

In the other preferable embodiment of the first aspect, the cord is flat and a direction of the long size in the cord is substantially coincident with the direction of the maximum diameter in the core.

According to a second aspect of the invention, there is the provision of in a pneumatic tire comprising a carcass as a main skeleton toroidally extending between a pair of bead portions and a belt comprised of plural layers arranged outside the carcass in a radial direction thereof, an improvement wherein steel cords as defined above are applied to at least one layer of the belt so as to arrange a direction of a maximum diameter in the core along a widthwise direction of the belt.

According to a third aspect of the invention, there is the provision of a process for producing a steel cord comprising a core formed by bundling plural filaments without twisting and a sheath formed by winding plural filaments around the cord through a tubular-type twisting machine, which comprises introducing the filaments constituting the core through a position located inside a barrel of the tubular-type twisting machine and separated from the barrel into an assemble portion integrated with the filaments constituting the sheath.

In a preferable embodiment of the third aspect, the filaments constituting the sheath are wound around the filaments constituting the core between a pair of rollers arranged in the assemble portion.

In another preferable embodiment of the third aspect, the filaments constituting the sheath are wound around the filaments constituting the core in a twisting die having a flat-shaped hole at its section arranged in the assemble portion.

In the other preferable embodiment of the third aspect, the steel cord after twisting is corrected by correcting rollers.

According to a fourth aspect of the invention, there is the provision of a tubular-type twisting machine comprising a rotating barrel and an assemble portion for integrating plural filaments at an outside of the rotating barrel and on a rotating axis of the barrel, wherein all of bobbins each wound with the filament are arranged at an inside of the rotating barrel.

In a preferable embodiment of the fourth aspect, the bobbins each wound with the filament constituting a core of a steel cord are arranged at the side of the assemble portion as compared with the bobbins each wound with the filament constituting a sheath of the steel cord.

In another preferable embodiment of the fourth aspect, a pair of rollers are arranged in the assemble portion.

In the other preferable embodiment of the fourth aspect, a twisting die having a flat-shaped hole at its section is arranged in the assemble portion.

BRIEF DESCRIPTION OF THE DRAWINGS

The invention will be described with reference to the accompanying drawings, wherein.

DESCRIPTION OF THE PREFERRED EMBODIMENTS

Figure 1:
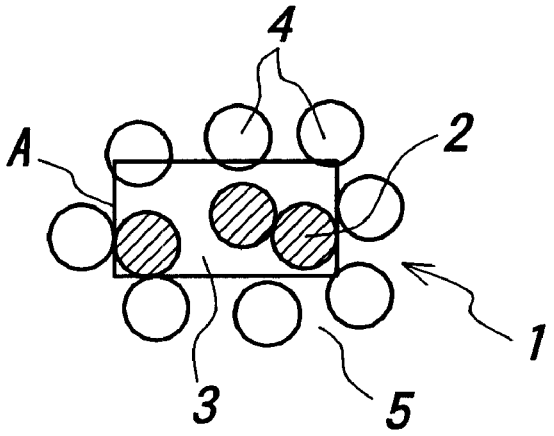
FIG. 1 is a diagrammatically section view of a first embodiment of the steel cord according to the invention.

In FIG. 1 is diagrammatically shown a section of a steel cord 1 according to the invention having a 3+8 construction applied to a belt of a pneumatic tire or the like. The steel cord is constituted by twisting eight filaments 4 as a sheath 5 around a core 3 comprised of three filaments 2 shown by hatching in FIG. 1 and bundled side by side without twisting.

Figure 2:
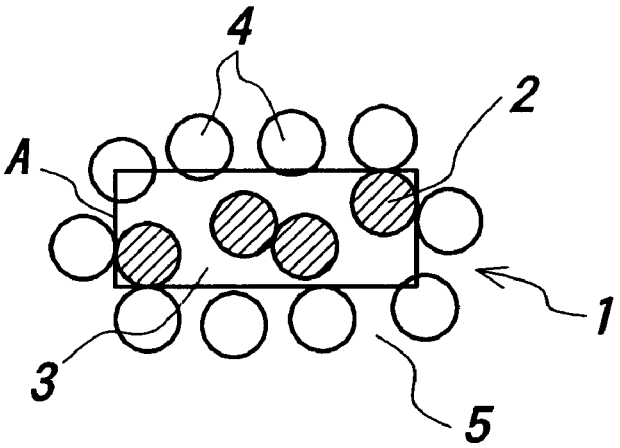
FIG. 2 is a diagrammatically section view of a second embodiment of the steel cord according to the invention.

The steel cord 1 having a 4+10 construction shown in FIG. 2 is constituted by twisting ten filaments 4 as a sheath 5 around a core 3 comprised of four filaments 2 shown by hatching in FIG. 2 and bundled side by side without twisting.

Figure 3:
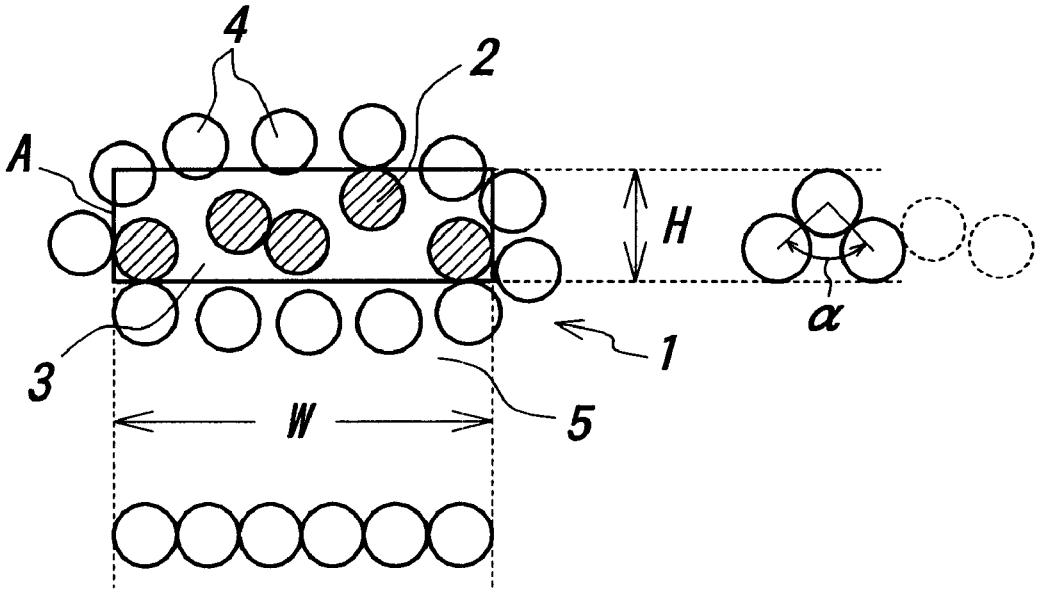
FIG. 3 is a diagrammatically section view of a third embodiment of the steel cord according to the invention.

The steel cord 1 having a 5+13 construction shown in FIG. 3 is constituted by twisting thirteen filaments 4 as a sheath 5 around a core 3 comprised of five filaments 2 shown by hatching in FIG. 3 and bundled side by side without twisting.

Figure 4:
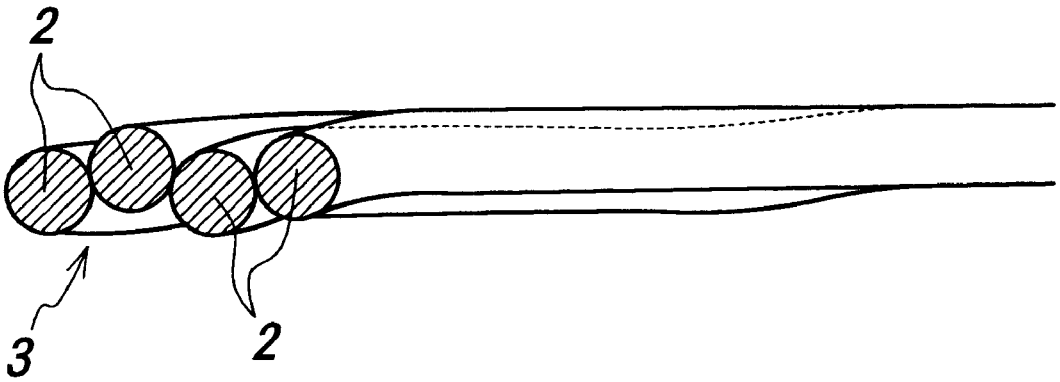
FIG. 4 is a schematic view illustrating an arrangement of filaments in a core.

In all of the above cords, it is important that an arrangement of the filaments 2 constituting the core 3 differs between at least a part of the core in a longitudinal direction thereof and the other part thereof at a section perpendicular to the longitudinal direction of the core (hereinafter abbreviated as cross section). That is, when three or more filaments are arranged side by side in the core 3, it is not necessarily required to uniformly continue the arrangement of the filaments in the longitudinal direction of the core. Rather, it is recommended that the filament arrangement is disordered and different cross sections in the relative arrangement of the filaments are mixed in the longitudinal direction of the core as shown in FIG. 4.

Because, the core filaments are arranged side by side without twisting with each other, but these filaments are not arranged straight in at least a part of core in the longitudinal direction thereof, so that when tensile load is applied to the cord, the core filaments do not preferentially bear the load different from this type of the conventional cord or the tensile load concentrated in the core of the conventional cord is dispersed into the sheath and hence the bearing ratio of tensile load in the core is reduced. As a result, the bearing efficiency of tensile load as a whole of the cord is increased and the durability of the cord is improved.

Particularly, it is favorable that a ratio of the portion straightforward arranging the filaments in the longitudinal direction of the core becomes smaller. Concretely, it is favorable that the arranging form of the core filaments has at least two different cross sections within one twisting pitch of the sheath and no portion straightforward arranging the filaments.

More preferably, a difference between one winding pitch of the sheath and a straight-extended length of each filament constituting the core existent in the one winding pitch is advantageous to be 0.9–1.1 times a stretchable amount of the sheath in the axial direction of the cord within one winding pitch of the sheath. Thus, the tensile load applied to the cord can equally be born by the core and the sheath.

The term "straight-extended length of each filament constituting the core" used herein means a length of each filament when the filament existent in the one winding pitch is extended straight. And also, when the sheath is stretched in the axial direction of the cord, the sheath filaments twisted around the core move so as to reduce the diameter thereof toward the core in accordance with a distance between the filaments, a twist angle and the like and to increase the length of the cord in the axial direction. The movement of the sheath filaments is possible until the filaments in the sheath close to the core. A moving amount of a component in the sheath filament in the axial direction of the cord per one winding pitch of the sheath until the filaments in the sheath close to the core is defined as a stretchable amount of the sheath in the axial direction of the cord per one winding pitch of the sheath.

As mentioned above, it is advantageous that there is a scattering in the arrangement of the filaments constituting the core. On the other hand, when a diameter of the filament is d and the number of filaments in the core is n at a cross section of the core, it is necessary that all filaments constituting the core are arranged in a rectangle having a long side of $d\times(n+0.5)$ and a short side of $d\times(1+1/2)$, more preferably a long side of $d\times(n+0.5)$ and a short side of $d\times(1+1/2)$.

That is, when a region housing all filaments of the core is explained with reference to a cord having a 5+13 construction as shown in FIG. 3, a length W of a long side in such a region A is $W=d\times(n+1)$, which corresponds to a width when (n+1) core filaments each having a diameter d are closely arranged side by side on a line. More preferably, the length W of the long side is $d\times(n+0.5)$.

Because, the tensile rigidity can be increased without damaging the bending anisotropy when the length W of the long side in the region A housing all filaments in the core is $d\times(n+1)$.

And also, a length H of a short side in the region A is $H=d\times(1+1/2^{1/2})$, which corresponds to a height when an angle defined by line segments connecting centers of closely adjacent three filaments to each other is 90°. More preferably, the length H of the short side is $d\times\{1+(1/2)\}$, which corresponds to $\alpha=120°$.

When the length H of the short side in the region A is $d\times(1+1/2^{1/2})$, the arrangement corresponding to the angle $\alpha$ of less than 90° is excluded as the arrangement of three adjacent filaments in the core, so that there is realized such a core structure that when compression or bending is applied to the core from the direction of the long side W, the core filament located on a top of the angle $\alpha$ does not easily move. Especially, when the arrangement of closing the adjacent filaments to each other is formed in any cross sections, the arrangement of the core filaments can be stabilized to more improve the bending anisotropy and the tensile rigidity.

Moreover, the definition of the region A defines a relative position relation between the core filaments in the cross section and hence there is not excluded a state of distorting the core in the longitudinal direction through the change in the direction of the region A or the direction of maximum diameter of the core toward the longitudinal direction of the core. However, in order to more effectively develop the properties such as anisotropy of the bending rigidity, high tensile rigidity and the like, the above distortion is preferable to become smaller, and it is particularly advantageous that the direction of maximum diameter of the core is substantially the same at any cross section in the longitudinal direction of the core. Concretely, it is favorable that when the steel cord is held straight as a whole, all filaments in the core are housed in an inside of a rectangular solid formed by extending the rectangle with a long side of $d\times(n+1)$ and a short side of $d\times(1+1/2^{1/2})$ in the longitudinal direction of the cord.

The reason why the number of filaments in the core is restricted to not less than 3 is due to the fact that when the number of filaments is not more than 2, sufficient anisotropy can not be given to the bending rigidity of the cord. Preferably, the number of filaments is not less than 4. On the other hand, the upper limit is not necessarily restricted, but when the number of filaments is not less than 6, it is difficult to house these filaments in the above region A, so that it is preferable to be not more than 5. As each filament constituting the core, it is favorable to use a high carbon steel wire plated with brass and having the same diameter selected from a range of 0.10–0.40 mm.

On the other hand, the number of filaments in the sheath is not especially restricted, but when the number is too small, the shape of the cord is not stable, so that the number of filaments in the sheath is preferable to be made not less than 2 times of the number of filaments in the core. Inversely, when the number of filaments in the sheath is too large, the rubber penetrability and the adhesion property between the core and the sheath are obstructed, so that the number of filaments in the sheath is desirable to be made not more than 2 times plus 3 of the number of filaments in the core. Each of the filaments constituting the sheath is required to have a diameter corresponding to not less than ⅔ of the diameter of the filament constituting the core in order to provide a space between the filaments in the sheath and prevent from curling in a treat, but when the diameter of the filament in the sheath exceeds that of the filament in the core, the working becomes difficult and the flattening of the cord is obstructed, so that it is favorable to render the diameter of the filament in the sheath into not more than the diameter of the filament in the core. The sheath is preferable to be made from the filaments having the same diameter selected from the above range.

Figure 5:
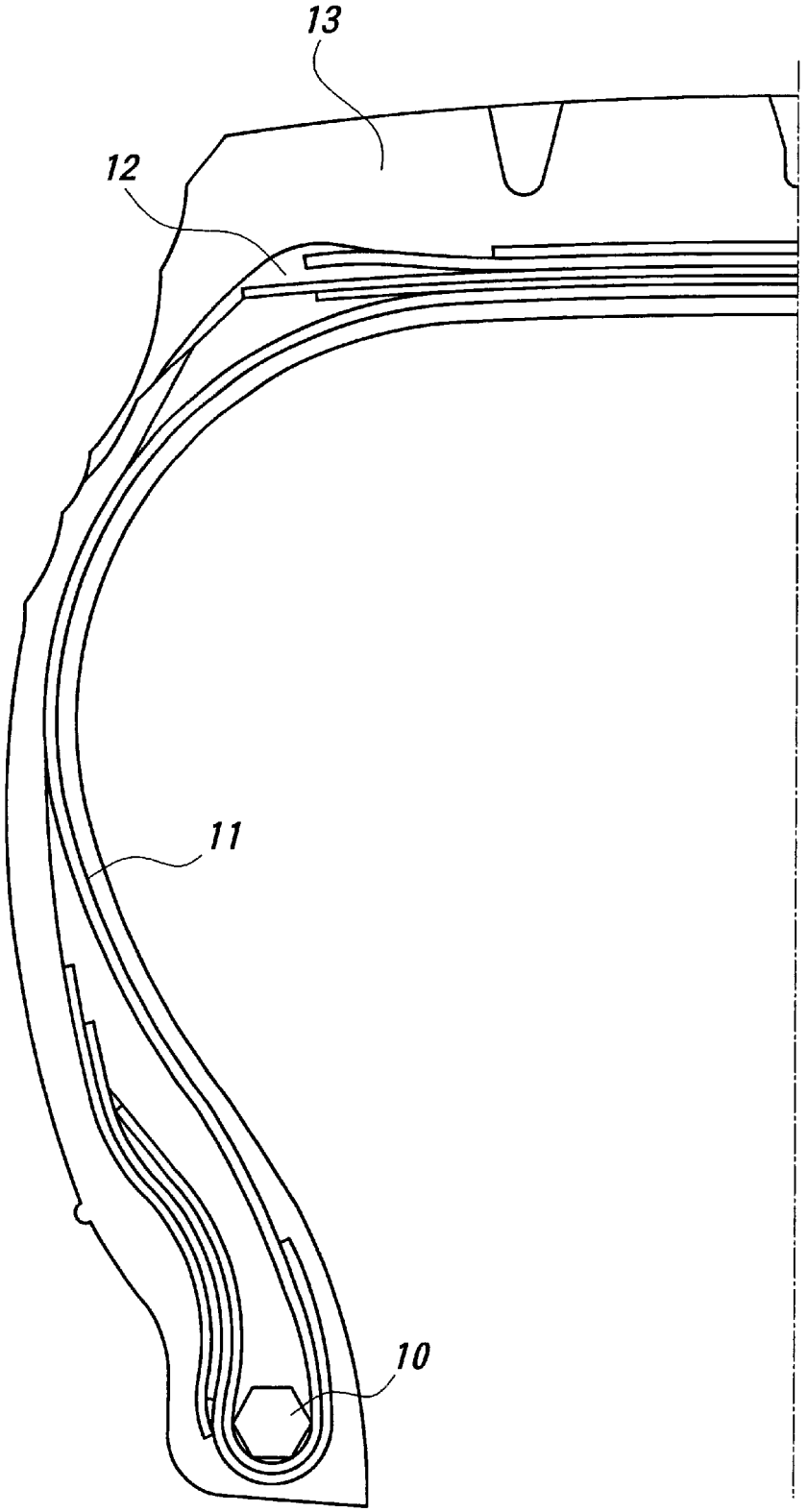
FIG. 5 is a diagrammatically left-half section view of an embodiment of the pneumatic tire according to the invention.

The above cord is used as a reinforcement for a belt of a tire by arranging many cords in parallel to each other and embedding them in a rubber sheet to form a ply and applying the ply to the belt. In this case, a tire for truck and bus as shown in FIG. 5 is advantageously adaptable as the tire.

This tire comprises a carcass 11 comprised of a rubberized ply containing steel cords toroidally extending in a radial direction between a pair of bead cores 10, a belt 12 comprised of at least three belt layers disposed on an outside of a crown portion of the carcass 11 in the radial direction of the tire, and a tread 13 arranged on an outside of the belt 12 in the radial direction.

Figure 6:
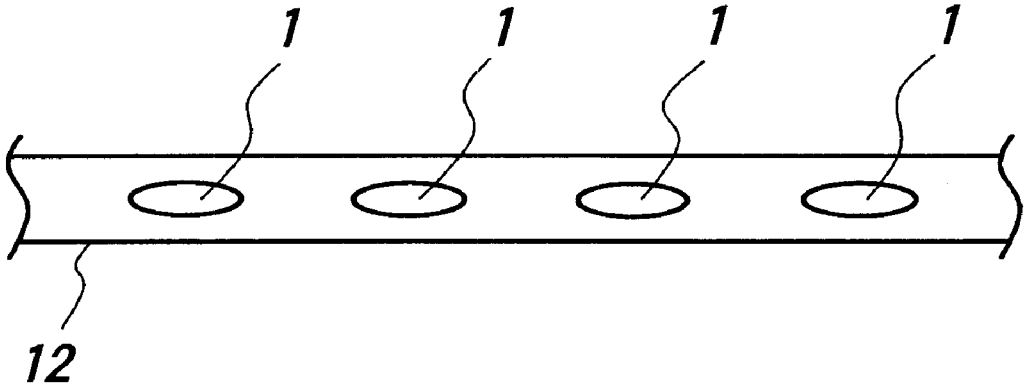
FIG. 6 is a schematic view illustrating an arrangement of cords in a belt.

In the illustrated embodiment, the belt 12 has a four-layer laminated structure wherein at least a pair of layers among plural layers each containing many steel cords arranged obliquely with respect to the ply cord of the carcass 11, preferably at an inclination angle of 10–30° are laid one upon the other so as to cross the steel cords of these layers with each other. The invention is characterized by using the above-defined cords as the steel cord constituting the belt 12. In this case, it is favorable that the direction of the maximum diameter in the steel cord according to the invention is arranged along the widthwise direction of the belt 12 as shown in FIG. 6 in order to utilize the properties of such a steel cord as a reinforcement for the belt.

That is, the steel cord according to the invention is not substantially distorted in the longitudinal direction because the direction of maximum diameter in the core is substantially coincident with the direction of long size in the cord, so that the difference of the bending rigidity between the long size direction and the short size direction in the cord becomes large. When the cords are applied to the belt according to the above arrangement, the circumferential rigidity of the tire is increased without increasing the radial rigidity, whereby the steering stability of the tire can be improved without damaging the ride comfort.

Since the cross sectional shape of the cord is flat, the thickness of the belt can be reduced when the cord is applied as a reinforcement for the belt. And also, the helical winding shape of the filament constituting the sheath is flat, so that a space is easily formed between the sheath filaments and hence rubber can surely be penetrated into the cord in the belt layer. Further, the direction of maximum diameter in the core (the long size direction of the cord) is arranged along the widthwise direction of the belt, whereby there can be formed a belt being light in the weight and high in the tensile rigidity.

Figure 14:
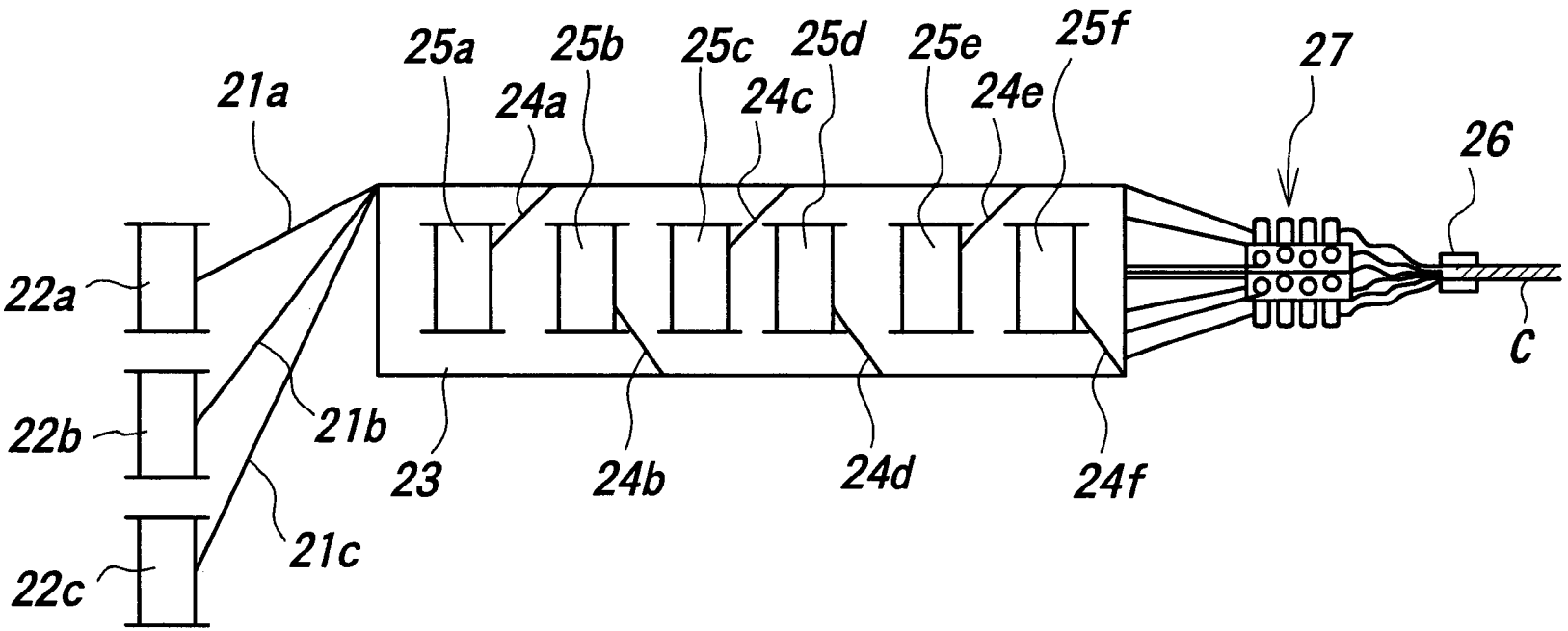
FIG. 14 is a diagrammatic view of the conventional tubular-type twisting machine.

In general, this type of the steel cord is produced by using a tubular-type twisting machine shown in FIG. 14 as described in JP-A-9-158065. That is, three bobbins 22*a*–22*c* wound with three core filaments 21*a*–21*c* are located at an outside of a rotating barrel 23, and six bobbins 25*a*–25*f* wound with six sheath filaments 24*a*–24*f* are located in an inside of the rotating barrel 23. The core filaments 21*a*–21*c* are taken out from the bobbins 22*a*–22*c,* fed into the inside of the rotating barrel 23 so as to arrange them side by side, guided to a top end of the rotating barrel 23 along an inner wall face thereof and introduced into a twisting die 26 located on a rotating axis of the barrel 23 outside the top end thereof. On the other hand, the sheath filaments 24*a*–24*f* are taken out from the bobbins 25*a*–25*f* and guided to the top end of the barrel 23 along the inner wall face thereof and introduced into a preformer 27 located on the rotating axis of the barrel 23 outside the top end thereof, at where these sheath filaments 24*a*–24*f* are subjected to a forming work having the same helical shape as in a twisted state and then fed into the twisting die 26. When the rotating barrel 23 is rotated, the sheath filaments 24*a*–24*f* are wound around a core 21 comprised of the core filaments 21*a*–21*c* at the twisting die 26 to obtain a cord C.

Figure 15:
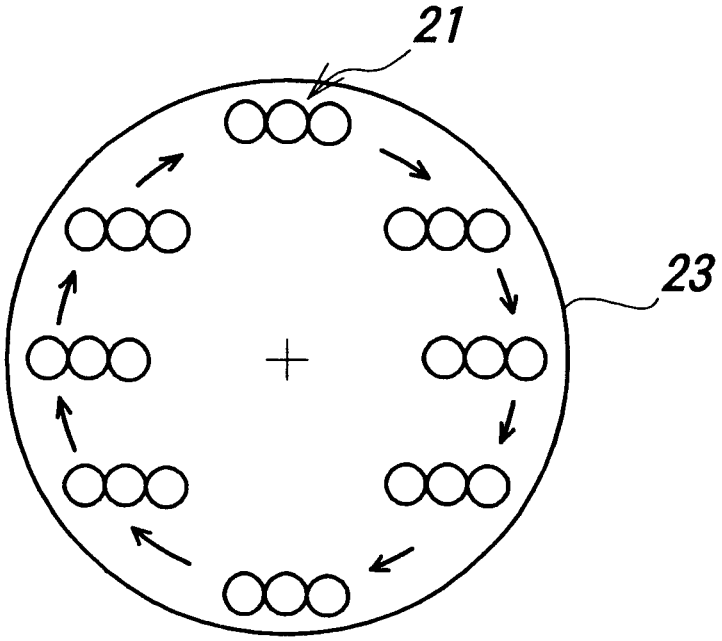
FIG. 15 is a schematic view illustrating an ideal arrangement of core filaments in the twisting.
Figure 16:
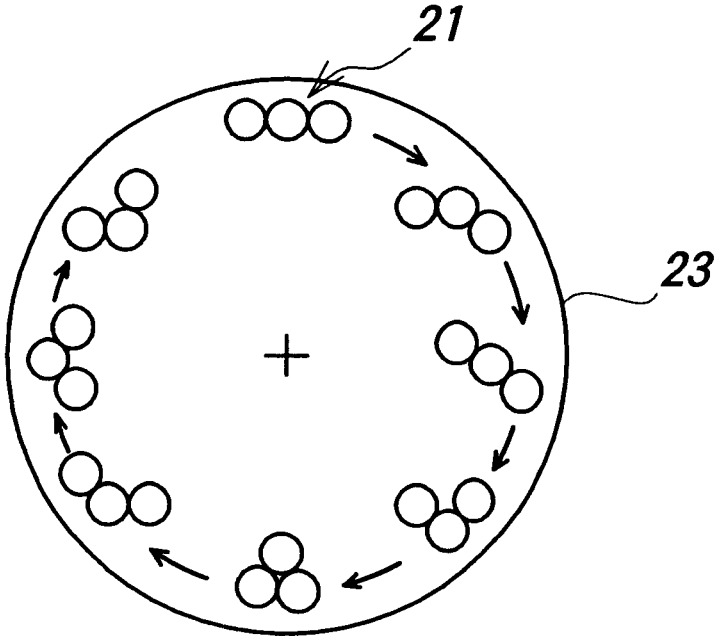
FIG. 16 is a schematic view illustrating an actual arrangement of core filaments in the twisting.

When the core filaments are introduced into the inside of the rotating barrel 23 at a state of arranging side by side, even after the passage through the barrel along the inner wall face thereof, such an arrangement must be maintained as shown in FIG. 15. However, it is impossible to avoid the change in the arrangement of the core filaments due to the resistance or the like in the passage of the core filaments along the inner wall face of the barrel, so that the arrangement of the core filaments is actually and irregularly disordered as shown in FIG. 16 and hence the cross sectional shape of the core 21 introduced into the twisting die variously changes in the longitudinal direction of the core. For example, the arranging direction of the core filaments is changed to render the core into a distorted state, or the core filaments are crossed with each other to obstruct the flattening of the core in an extremely case.

As a result that the desirable flattened shape can not be given to the core, the resulting cord can not attain the desirable flattened shape. Even if the correction is carried out through correcting rollers at a delivery side of the twisting die, it is very difficult to conduct the correction of the core. Moreover, it is possible to modify the appearance of the cord, e.g. the distortion by strong correction, but elastic distortion is still latent, which again develop the distortion in the breakage of the cord.

Thus, the flattened cord produced by the conventional technique does not attain the adequate flattening formation, so that it is difficult to sufficiently develop the properties expected in the flattened cord.

On the contrary, the flattened steel cords according to the invention can be produced without causing distortion in the arrangement of the core filaments by the aforementioned method using the tubular-type twisting machine. The production of such a steel cord is described in detail with reference to FIGS. 7–13 below.

In the invention, it is important that bobbins 22*a*–22*c* wound with filaments 21*a*–21*c* constituting the core are arranged at a front side inside a rotating barrel 23 or at a twisting side, and bobbins 25*a*–25*f* wound with filaments 24*a*–24*f* constituting the sheath are arranged at a rear side inside the barrel 23. That is, the bobbins 22*a*–22*c* for the core filaments 21*a*–21*c,* which have been located at the outside of the barrel 23 in the conventional technique, are arranged at the inside of the barrel 23 and at the front side of the barrel as compared with the bobbins 25*a*–25*f* for the sheath filaments 24*a*–24*f,* whereby there is surely obtained a passing course for the core filament that the core filaments 21*a*–21*c* are run on a position separated from the inner wall of the barrel 23, preferably a rotating axis of the barrel 23 toward the outside of the barrel 23 without detouring to the bobbins 25*a*–25*f* for the sheath filaments.

When the core filaments is fed from the inside of the rotating barrel 23 toward the twisting die located at the outside of the barrel without passing along the inner wall face of the barrel as mentioned above, they are led toward the outside of the barrel 23 while maintaining the side-by-side arrangement of the core filaments without being influenced by the movement of the rotating barrel. As a result, the core filaments having no distortion or crossed portion and continuing the adequate arrangement in the longitudinal direction are introduced into an assemble portion located outside the rotating barrel 23. In the twisting die 26 located at the outside of the rotating barrel 23, the sheath filaments 24*a*–24*f* fed through a preformer 27 are wound around a core comprised of side-by-side arranged filaments through the rotation of the rotating barrel 23 to obtain the desirable flattened steel cord.

Moreover, there is a fear that when tension applied to the filament is low in the introduction of the core filaments taken out from the bobbins into the twisting die, the core filaments easily move at the twisting step of the sheath filaments around the core and the arrangement of the core filaments is disordered. Therefore, it is favorable to apply tension to the core filaments up to an extent of controlling the movement of the core filaments.

Figure 8A:
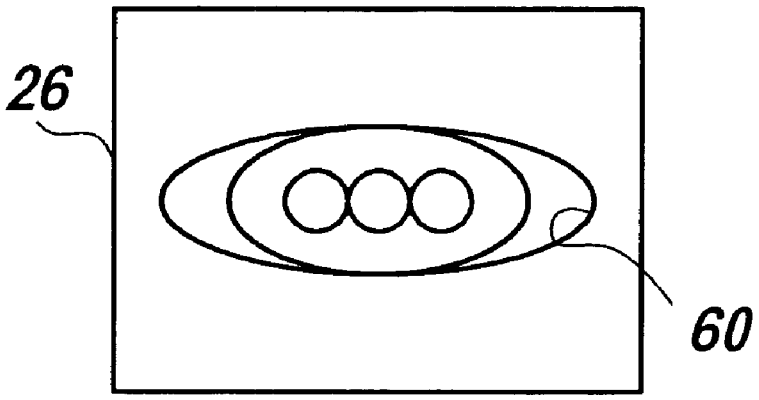
FIGS. 8*a* and 8*b* are schematically section views of twisting dies used in the invention, respectively.
Figure 8B:
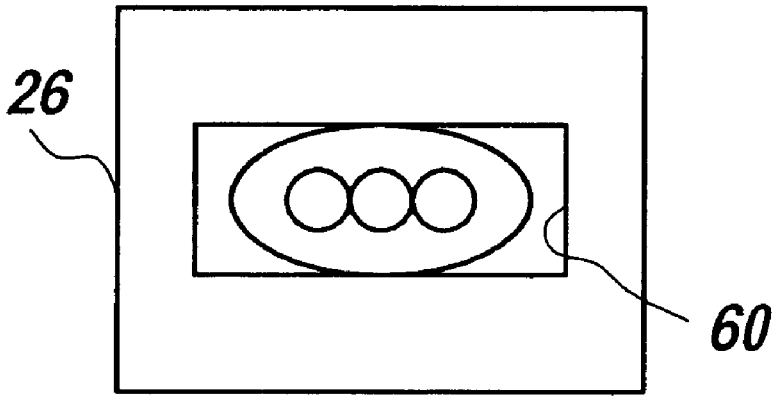

The twisting die 26 arranged in the assemble portion outside the rotating barrel 23 has a hole 60 having a sectional shape such as an ellipse, a rectangle or the like as shown in FIG. 8*a* or 8*b.* This hole 60 acts to maintain the side-by-side arrangement of the core filaments when the sheath filaments are wound around the core by twisting under a restriction of the hole 60.

Figure 9:
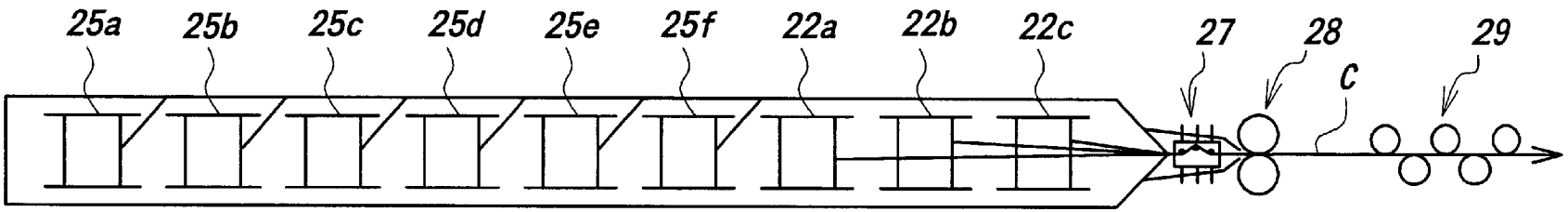
FIG. 9 is a diagrammatic view of a second embodiment of the tubular-type twisting machine according to the invention.
Figure 10A:
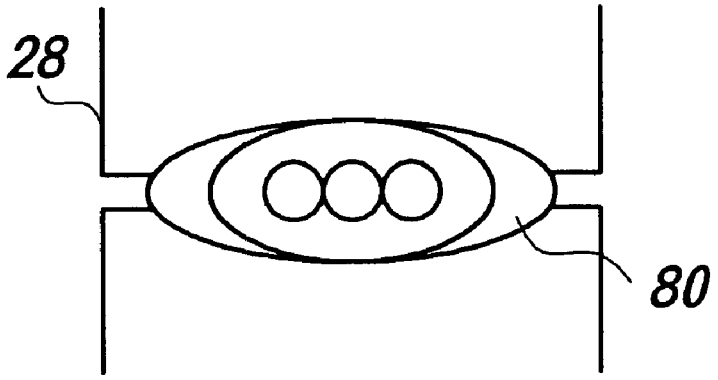
FIGS. 10*a* and 10*b* are schematically section views of roller pairs used in the invention, respectively.
Figure 10B:
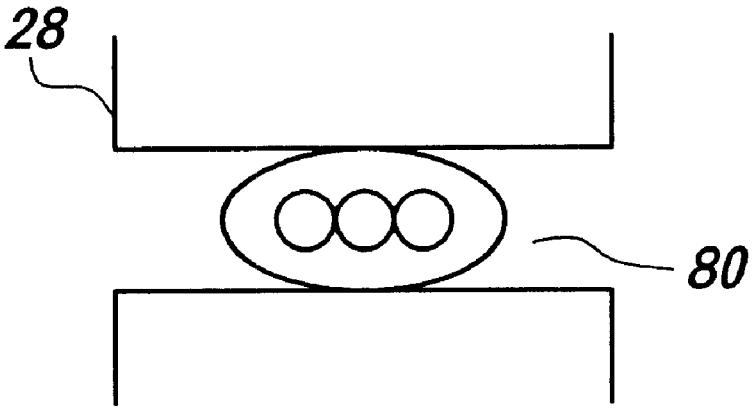

As shown in FIG. 9, a pair of rollers 28 are arranged in the assemble portion instead of the twisting die 26 and the twisting can be performed between the rollers 28. Even in the pair of rollers 28, it is advantageous to provide a gap 80 between rollers having a sectional shape such as an ellipse, a rectangle or the like as shown in FIG. 10*a* or 10*b* likewise the case of using the twisting die 26.

Furthermore, it is preferable that a group 29 of correcting rollers are arranged at an exit side of the twisting die 26 or the roller pair 28 to correct the arranging disorder of each filament and the like when the sheath filaments are wound around the core. Moreover, the forming of the sheath filament is usually carried out in a cylindrically helical shape, so that it is required to flatten the formed shape by the correcting roller group 29. Thus, the sheath filaments are wound around the core fed without disordering the side-by-side arrangement, whereby there is obtained the cord having no disorder in the arrangement of the core filaments. Even if the arrangement of the filaments is disordered in the twisting at the assemble portion of the core and sheath, it is possible to correct the disorder of the filaments by the correcting roller group 29.

Figure 7:
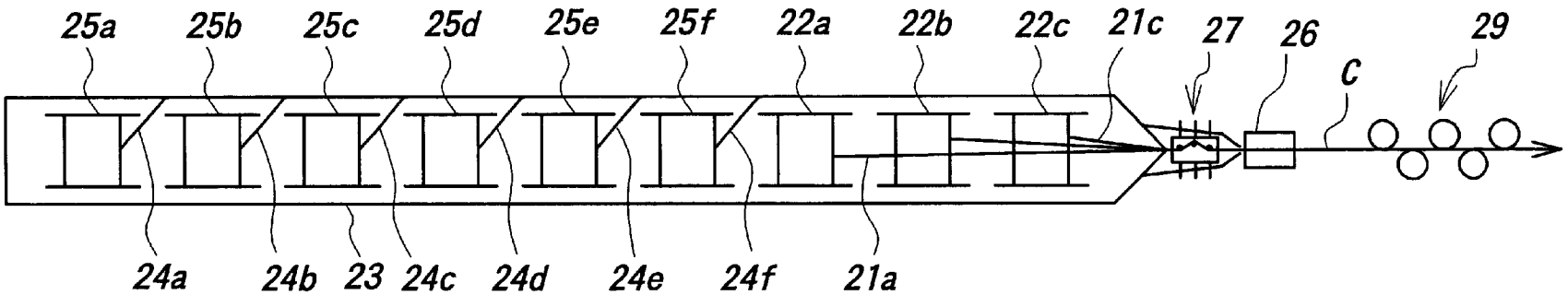
FIG. 7 is a diagrammatic view of a first embodiment of the tubular-type twisting machine according to the invention.
Figure 11:
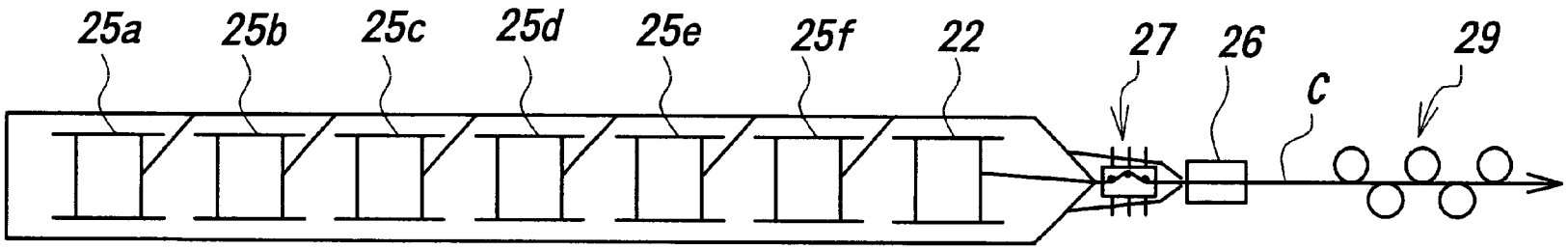
FIG. 11 is a diagrammatic view of a third embodiment of the tubular-type twisting machine according to the invention.
Figure 12:
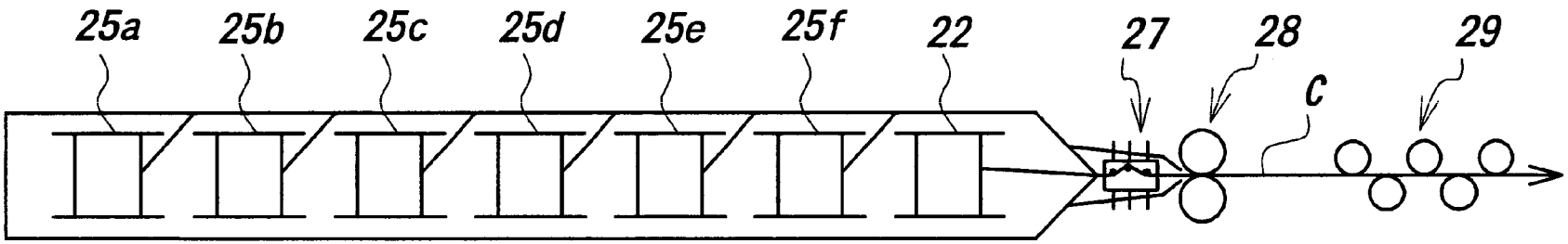
FIG. 12 is a diagrammatic view of a fourth embodiment of the tubular-type twisting machine according to the invention.
Figure 13A:
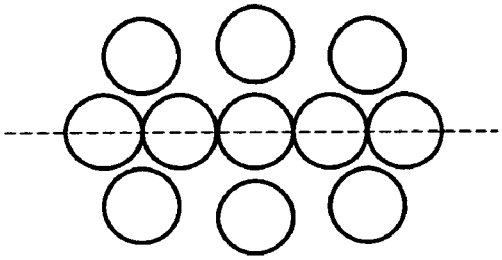
FIGS. 13*a* to 13*d* are diagrammatic views illustrating an arranging angle of filaments in the core, respectively.
Figure 13B:
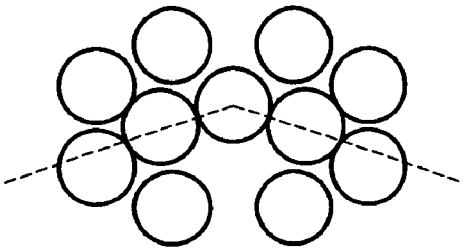
Figure 13C:
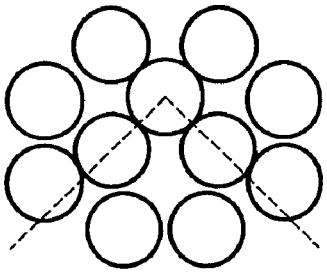
Figure 13D:
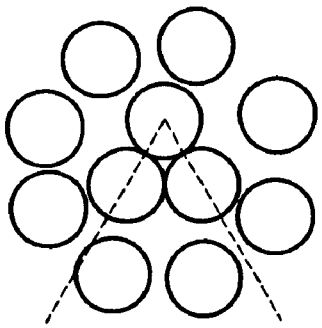

In the twisting machine shown in FIG. 7 or 9, the bobbin is provided every the core filament and arranged in the inside of the rotating barrel 23. However, as shown in FIG. 11 or 12, a single bobbin 22 wound with plural filaments is arranged in the inside of the rotating barrel 23 wherein plural filaments, for example, three filaments may simultaneously be taken out from the bobbin 22 and introduced from the inside of the rotating barrel 23 toward the outside thereof. In the latter case, the number of bobbins for the core filament can be decreased, so that a space for the arrangement of the bobbin can be saved in the rotating barrel. Incidentally, the take-up of plural filaments on a single bobbin is advantageous in view of the productivity because the filaments can be produced by using so-called multi wire-drawing machine capable of simultaneously drawing plural wires through one machine.

The following examples are given in illustration of the invention and are not intended as limitations thereof.

EXAMPLES 1–3.

Comparative Examples 1–3

There are prepared radial tires for truck and bus having a tire size of 11R22.5 and a structure shown in FIG. 5 by applying cords with a specification shown in Table 1 to a belt of the tire, wherein a long size direction of the cord is arranged along a widthwise direction of the belt and an inclination angle of an axial direction of the cord with respect to an equatorial plane of the tire is 52° upward to the right, 20° upward to the right, 20° upward to the left, and 20° upward to the left, respectively, from an inner belt layer among four belt layers in a radial direction in this order. With respect to the thus obtained tires are examined the cornering power, rolling resistance, wear resistance and separation resistance at belt end. And also, the strength at break, rubber penetrability, tensile rigidity and fatigue limit are examined with respect to the rubberized cord or single cord. Furthermore, the tensile rigidity, in-plane bending rigidity and out-of-plane bending rigidity are examined with respect to a belt member or a cord-rubber composite body used in the belt. The results are also shown in Table 1.

Moreover, the strength at break, rubber penetrability, tensile rigidity and fatigue limit with respect to the rubberized cord are examined as follows and represented by an index on the basis that the result of Example 1 is 100, respectively.

That is, the strength at break is evaluated by a load measured when the steel cord is broken while increasing tensile load.

The rubber penetrability is evaluated by an area of rubber penetrated into the inside of the cord as observed at the section of the cord.

The tensile rigidity is evaluated by an increment of elongation when the tensile load is increased from 0.25 kg to 5 kg.

The fatigue limit is evaluated by a value of bending stress when the test is completed without being broken by repeatedly adding the bending stress to the cord at a given repetitive number.

And also, the tensile rigidity, in-plane bending rigidity and out-of-plane bending rigidity with respect to the belt member are examined as follows and represented by an index on the basis that Example 1 is 100, respectively.

That is, the tensile rigidity is measured from a relation between elongation and load when a sample having a width of 50 mm and a length of 400 mm is cut out from the belt layer located on a crown central portion of the tire and attached to a tensile testing machine and tensioned at a rate of 10 mm/min in a direction corresponding to the equatorial direction of the tire.

The in-plane bending rigidity is evaluated by an initial gradient value in a curve of bending strain and bending load obtained by preparing a belt member (cord-rubber composite body) having a length of 80 mm and a width of 80 mm and subjecting to a three-point bending test at a pan of 60 mm in the widthwise direction of the belt member.

The out-of-plane bending rigidity is evaluated by an initial gradient value in a curve of bending strain and bending load obtained by preparing a belt member (cord-rubber composite body) having a length of 80 mm and a width of 80 mm and subjecting to a three-point bending test at a pan of 60 mm in the thickness direction of the belt member.

Moreover, the cornering power, rolling resistance, wear resistance and separation resistance at belt end with respect to the tire are examined as follows and represented by an index on the basis that Example 1 is 100, respectively.

That is, the cornering power is measured under conditions of a speed of 50 km/h and a slip angle of ±2° by using a flat-belt type testing machine for the evaluation of cornering properties after the tire mounted onto a rim is inflated and adjusted to a given internal pressure and subjected to a given load.

The rolling resistance is evaluated by putting the tire adjusted to a given internal pressure onto a drum testing machine having an outer diameter of 1780 mm, training at 80 km/h for 30 minutes, readjusting the internal pressure to a given value, raising the speed up to 200 km/h and then running by inertial to measure a time required for decreasing the speed from 185 km/h to 20 km/h.

The wear resistance is evaluated by actually running the tire mounted onto a vehicle up to an approximately complete worn state to measure a running distance per 1 mm of worn depth.

The separation resistance at belt end is evaluated by putting the tire adjusted to a given internal pressure onto a drum testing machine having an outer diameter of 178 mm and running for 12 hours while intermittently applying a slip angle of 3.5° to measure a crack length created in an end portion of the belt layer.

TABLE 1

| | | Example 1 | Comparative Example 1 | Example 2 | Example 3 | Comparative Example 2 | Comparative Example 3 |
|---|---|---|---|---|---|---|---|
| Filaments of core | Number of filaments | 4 | 4 | 3 | 3 | 3 | 3 |
| | Diameter (mm) | 0.26 | 0.26 | 0.26 | 0.26 | 0.26 | 0.26 |
| Region A of core | Long side (mm) | 1.04~1.15 | 0.64~1.05 | 0.78~1.02 | 0.78~0.89 | 0.80~0.90 | 0.78 |
| | Short side (mm) | 0.26~0.38 | 0.26~0.64 | 0.26~0.43 | 0.26~0.38 | 0.32~0.45 | 0.26 |

TABLE 1-continued

| | | Example 1 | Comparative Example 1 | Example 2 | Example 3 | Comparative Example 2 | Comparative Example 3 |
|---|---|---|---|---|---|---|---|
| Filaments of sheath | Number of filaments | 10 | 10 | 8 | 8 | 8 | 8 |
| | Diameter (mm) | 0.26 | 0.26 | 0.26 | 0.26 | 0.26 | 0.26 |
| Rubberized cord | Strength at break | 100 | 102 | 100 | 99 | 103 | 95 |
| | Rubber penetrability | 100 | 75 | 100 | 100 | 90 | 100 |
| | Tensile rigidity | 100 | 96 | 100 | 101 | 97 | 102 |
| | Bending anisotropy | 100 | 72 | 100 | 103 | 87 | 105 |
| | Fatigue limit | 100 | 88 | 100 | 99 | 91 | 92 |
| Belt member | Tensile rigidity | 100 | 82 | 100 | 101 | 87 | 103 |
| | In-plane bending rigidity | 100 | 86 | 100 | 100 | 88 | 101 |
| | Out-of-plane bending rigidity | 100 | 106 | 100 | 100 | 105 | 100 |
| Tire | Cornering power | 100 | 97 | 100 | 100 | 98 | 100 |
| | Rolling resistance | 100 | 94 | 100 | 100 | 95 | 100 |
| | Wear resistance | 100 | 95 | 100 | 100 | 96 | 100 |
| | Separation resistance at belt end | 100 | 89 | 100 | 100 | 91 | 100 |

EXAMPLE 4

A steel cord is produced by twisting 8 sheath filaments each having a diameter of 0.26 mm around three core filaments each having the same diameter as mentioned above at a twisting pitch of 18 mm by means of a twisting machine shown in FIG. 12. In this case, a single bobbin wound with the three core filaments is used and the taking-out tension is 10 kgf. And also, a design value of the cord is a long size of 1.30 mm and a short size of 0.78 mm.

For the comparison, a steel cord is produced in the same manner as mentioned above by using a twisting machine shown in FIG. 14. That is, a single bobbin wound with three core filaments is arranged outside a rotating barrel and the core filaments are introduced from the single bobbin along an inner wall face of the rotating barrel toward a front side of the rotating barrel to conduct the twisting.

With respect to the thus produced cords, the sectional shape is observed at 250 points every an interval of 30 m over a length of 7500 m. That is, the arrangement of the core filaments at the section of the cord is evaluated by an arranging angle θ defined between line segments connecting center axes of the core filaments to each other as shown by typical embodiments in FIGS. 13*a* to 13*d*. In this case, when rank-A is $180° \geqq \theta > 150°$ and rank-B is $150° \geqq \theta > 90°$ and rank-C is $90° \geqq \theta > 60°$, a ratio of each rank is examined in all measured points to obtain results as shown in Table 2.

TABLE 2

| | Example 4 | Conventional Example |
|---|---|---|
| Section of cord | rank-A: 98.0% | rank-A: 8.0% |
| | rank-B: 0.4% | rank-B: 80.0% |
| | rank-C: 1.6% | rank-C: 12.0% |
| Intersection of core filaments | 0~6 points/50 m | 200~300 points/50 m |

As mentioned above, according to the invention, the tensile rigidity in the flattened steel cord having a core obtained by arranging filaments side by side without twisting can be improved without damaging the bending anisotropy. Therefore, it is possible to improve various performances of the tire by applying such cords to the belt in the tire.

According to the invention, the flattened steel cord having a core obtained by arranging filaments side by side without twisting can surely be produced without causing the disorder in the arrangement of the core filaments.

What is claimed is:

1. In a steel cord comprising a core formed by bundling three or more filaments side by side without twisting and a sheath of at least one layer comprised of plural filaments wound around the core, an improvement wherein an arrangement of the filaments constituting the core at a section perpendicular to a longitudinal direction of the core differs between at least a part in the longitudinal direction of the core and the other part thereof, and all filaments constituting the core in all section parts are arranged in a rectangle having a long side of $d\times(n+1)$ and a short side of $d\times(1+1/2^{1/2})$ when a diameter of the filament is d and the number of the filaments in the core is n.

2. A steel cord according to claim 1, wherein all filaments constituting the core are arranged in a rectangle having a long side of $d\times(n+0.5)$ and a short side of $d\times(1+1/2)$.

3. A steel cord according to claim 1, wherein the arrangement of the filaments constituting the core has different parts within one winding pitch of the sheath.

4. A steel cord according to claim 3, wherein a difference between one winding pitch of the sheath and a straight-extended length of each filament constituting the core existent in one winding pitch is 0.9–1.1 times a stretchable amount of the sheath in an axial direction of the cord within one winding pitch of the sheath.

5. A steel cord according to claim 1, wherein the number of filaments in the core is three or four.

6. A steel cord according to claim 5, wherein the filaments in the core are closed to each other.

7. A steel cord according to claim 1, wherein the sheath is one layer.

8. A steel cord according to claim 1, wherein a direction of maximum diameter in the core is substantially the same at any cross section in the longitudinal direction of the core.

9. A steel cord according to claim 1, wherein the cord is flat and a direction of the long size in the cord is substantially coincident with the direction of the maximum diameter in the core.

* * * * *